US007019499B2

(12) United States Patent
Chiu et al.

(10) Patent No.: US 7,019,499 B2
(45) Date of Patent: Mar. 28, 2006

(54) LOW NOISE FAST STABLE VOLTAGE REGULATOR CIRCUIT

(75) Inventors: Chi-Kun Chiu, Tao-Yuan Hsien (TW); Chi-Ming Hsiao, Tai-Chung (TW)

(73) Assignee: MediaTek Inc., Hsin-Chu Hsien (TW)

( * ) Notice: Subject to any disclaimer, the term of this patent is extended or adjusted under 35 U.S.C. 154(b) by 66 days.

(21) Appl. No.: 10/709,636

(22) Filed: May 19, 2004

(65) Prior Publication Data

US 2004/0232895 A1 Nov. 25, 2004

(30) Foreign Application Priority Data

May 20, 2003 (TW) ..... 92113647 A

(51) Int. Cl.
*G05F 1/40* (2006.01)

(52) U.S. Cl. ..... 323/279; 323/280

(58) Field of Classification Search ..... 323/279, 323/280, 274

See application file for complete search history.

(56) References Cited

U.S. PATENT DOCUMENTS 5,243,271 A * 9/1993 Lommers ..... 323/279
5,892,381 A 4/1999 Koifman et al.
6,188,210 B1 2/2001 Tichauer et al.
6,362,609 B1 3/2002 Gailhard
RE37,738 E 6/2002 Brkovic
6,420,857 B1 7/2002 Fukui

FOREIGN PATENT DOCUMENTS

JP 63167677 A2 7/1988

* cited by examiner

*Primary Examiner*—Shawn Riley
(74) *Attorney, Agent, or Firm*—Winston Hsu

(57) ABSTRACT

A low noise voltage regulator circuit with fast stable output voltage is disclosed. The low noise voltage regulator circuit contains a reference voltage generator, for generating a reference voltage; a switching circuit, which is electrically coupled to the output of reference voltage generator and has two states; and a stabilizing circuit. When the switching circuit is at a first state, the reference voltage is coupled to the stabilizing circuit without being filtered; when the switching circuit is at a second state, the reference voltage is filtered by a low pass filter before being coupled to the stabilizing circuit. A switching control signal is used to switch the switching circuit between the two states. The filtered reference voltage is used to generate a low noise regulated output voltage.

13 Claims, 13 Drawing Sheets

LOW NOISE FAST STABLE VOLTAGE REGULATOR CIRCUIT

BACKGROUND OF INVENTION

1. Field of the Invention

The present invention relates to a voltage regulator circuit, and more specifically, to a low noise and fast stable voltage regulator circuit.

2. Description of the Prior Art

A voltage regulator circuit is frequently used to provide a stable voltage source. In order to suppress the noise inherent in the reference voltage, a RC low pass filter is usually added in front of the voltage comparator to make sure that the voltage regulator circuit can generate an output voltage with low noise.

However, a RC low pass filter not only suppresses noise but also introduce a RC time delay while the signal is processed. This RC time delay causes the voltage regulator circuit to waste more time for stabilizing the voltage signal.

Please refer to FIG. 1, a simple block diagram of a low noise voltage regulator circuit of the prior art is illustrated. The low noise voltage regulator circuit 100 contains a reference voltage generator 110, a RC low pass filter 120, and a stabilizing circuit 130. The reference voltage generator 110 is electrically coupled to a first node 150, it is used to generate a reference voltage $V_r$. The RC low pass filter 120 is electrically coupled between the first node 150 and a second node 160, it receives the reference voltage $V_r$ from the first node 150 and generates a low noise voltage $V_{ln}$. The stabilizing circuit 130 is electrically coupled to the second node 160 and a third node 170, it receives the low noise voltage $V_{ln}$ from the second node 160 and generates a low noise stable voltage $V_{reg}$, then outputs the low noise stable voltage $V_{reg}$ to the third node 170.

If the reference voltage generator 110 starts to output the reference voltage $V_r$ at time t0, because of the time delay effect caused by the RC low pass filter 120, the low noise voltage $V_{ln}$ will be charged to the value of the reference voltage $V_r$ at time t0+Δt, where Δt>0. Even if the reference voltage $V_r$ is already stable at time t0, the stabilizing circuit 130 still have to wait until time t0+Δt to get the low noise voltage $V_{ln}$. Then the stabilizing circuit 130 can start to output the low noise stable voltage $V_{reg}$ at the third node 170. The time delay effect (that is, Δt) will slow down the speed of the whole circuit.

The switching delay on the low noise stable voltage $V_{reg}$ reduces the battery lifetime of the other consuming circuits which use the low noise stable voltage $V_{reg}$ as its power supply. Therefore it is desired to reduce the time delay effect on the signal caused by the RC low pass filter 120.

SUMMARY OF INVENTION

Therefore it is an objective of the present invention to provide a low noise fast stable voltage regulator circuit containing a switching circuit, which can switch between two different states to solve the time delay problem mentioned above.

In summary, the present invention provides a voltage regulator circuit for generating a stable voltage signal with low noise. According to the embodiment, the voltage regulator circuit contains a reference voltage generator, a switching circuit, and a stabilizing circuit. The reference voltage generator is electrically coupled to a first node, it generates a first voltage signal and outputs the first voltage signal to the first node. The switching circuit is electrically coupled to the first node, a second node, and a switching control signal, it receives the first voltage signal from the first node and processes on the first voltage signal to generate a second voltage signal, then outputs the second voltage signal to the second node. The switching circuit is capable of switching between a first state and a second state. When the switching circuit is at the first state, it functions like a voltage follower, the first voltage signal is coupled to become the second voltage signal without being filtered. When the switching circuit is at the second state, it functions like a RC low pass filter, the first voltage signal is filtered to generate the second voltage signal. The stabilizing circuit is electrically coupled to the second and a third node, it receives the second voltage signal from the second node and outputs the stable voltage signal from the third node.

After reading the following detailed description of the preferred embodiment that is illustrated in the various figures and drawings, these and other objectives of the present invention will no doubt become obvious to those of ordinary skills in the prior art. This invention can meet the requirement of having a regulated, low noise output and fast stable transient response at the same time.

DETAILED DESCRIPTION

Figure 1:
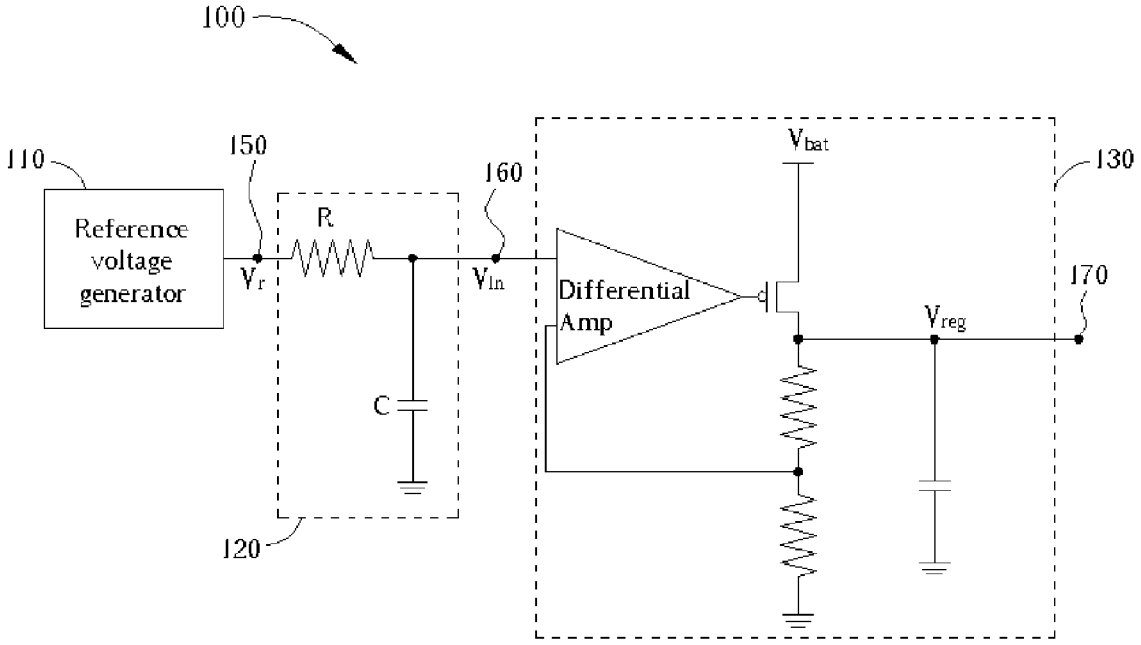
Fig. 1 Prior art
FIG. 1 is a block diagram of a conventional low noise voltage regulator circuit of the prior art.
Figure 2:
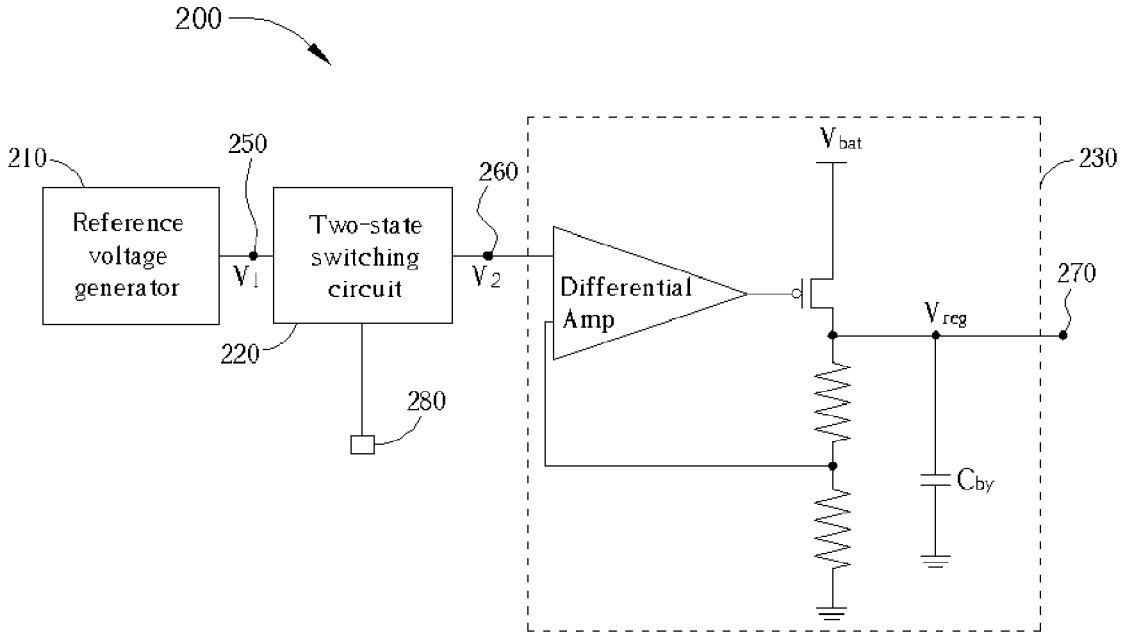
FIG. 2 is an embodiment block diagram of the low noise voltage regulator circuit of the present invention.

Please refer to FIG. 2, an embodiment block diagram of the low noise voltage regulator circuit of the present invention is illustrated. The low noise voltage regulator circuit 200 contains a reference voltage generator 210, a switching circuit 220, and a stabilizing circuit 230. The reference voltage generator 210 is electrically coupled to a first node 250, it generates a first voltage signal $V_1$ and outputs the first voltage signal $V_1$ to the first node 250. The switching circuit 220 is electrically coupled to the first node 250, a second node 260 and a switching control signal 280, it receives the first voltage signal $V_1$ from the first node 250 and processes on the first voltage signal $V_1$ to generate a second voltage signal $V_2$, then outputs the second voltage signal $V_2$ to the second node 260. The switching circuit 220 shown in FIG. 2 is capable of switching between a first state and a second state according to the switching control signal 280. When the switching circuit 220 is at the first state, it serves as a voltage follower. The first voltage signal $V_1$ is coupled to become the second voltage signal $V_2$ without being filtered. When the switching circuit 220 is at the second state, it serves as a RC low pass filter, the first voltage signal $V_1$ is filtered to generate the second voltage signal $V_2$. The stabilizing circuit 230 is electrically coupled to the second node 260 and a third node 270, it receives the second voltage signal $V_2$ from the second node 260 and outputs a third voltage signal $V_{reg}$ from the third node 270. The stabilizing circuit 230 includes a negative feedback path for providing a stable signal at the third node 270.

When the reference voltage generator 210 starts to output voltage signals, the switching circuit 220 is at the first state, the first voltage signal $V_1$ is coupled to become the second voltage signal $V_2$ without suffering from the RC time delay effect. Because the stabilizing circuit 230 can receive a non-delayed input voltage, the third voltage signal $V_{reg}$ will soon be stabilized. After the whole circuit stabilizes, the switching circuit 220 switches to the second state. Before and after the switching transient, the value of the second voltage signal V2 does not change much, hence the input voltage of the stabilizing circuit 230 remains about the same value and does not suffer from the time delay effect caused by the RC network. The regulator 200 can output a stable and low noise voltage.

Figure 3:
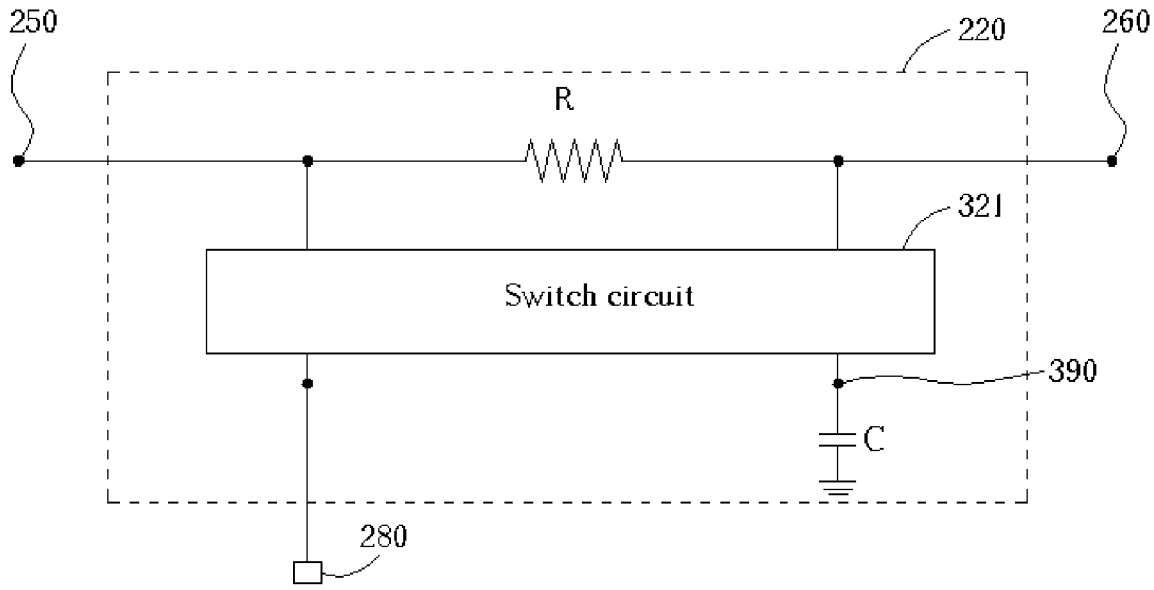
FIG. 3 is an embodiment block diagram of the switching circuit of FIG. 2.

Please refer to FIG. 3, an embodiment block diagram of the switching circuit 220 of FIG. 2 is illustrated. The switching circuit 220 contains a resistor R, a capacitor C, and a switch circuit 321. The resistor R is electrically coupled between the first node 250 and the second node 260. The capacitor C is electrically coupled between a fourth node 390 and the ground. The switch circuit 321 is electrically coupled to the first node 250, the second node 260, the fourth node 390 and the switching control signal 280. The switch circuit 321 can switch the switching circuit 220 between the first state and the second state according to the switching control signal 280. When the switching circuit 220 is at the first state, the switch circuit 321 couples the first node 250 to the fourth node 390. Hence, the first voltage signal $V_1$ on the first node 250 can be coupled to the second node 260 without being filtered. At this time the switching circuit 220 is similar to a voltage follower. When the switching circuit 220 is at the second state, the switch circuit 321 couples the second node 260 to the fourth node 390, at this time the switching circuit 220 is similar to a RC low pass filter.

Figure 4:
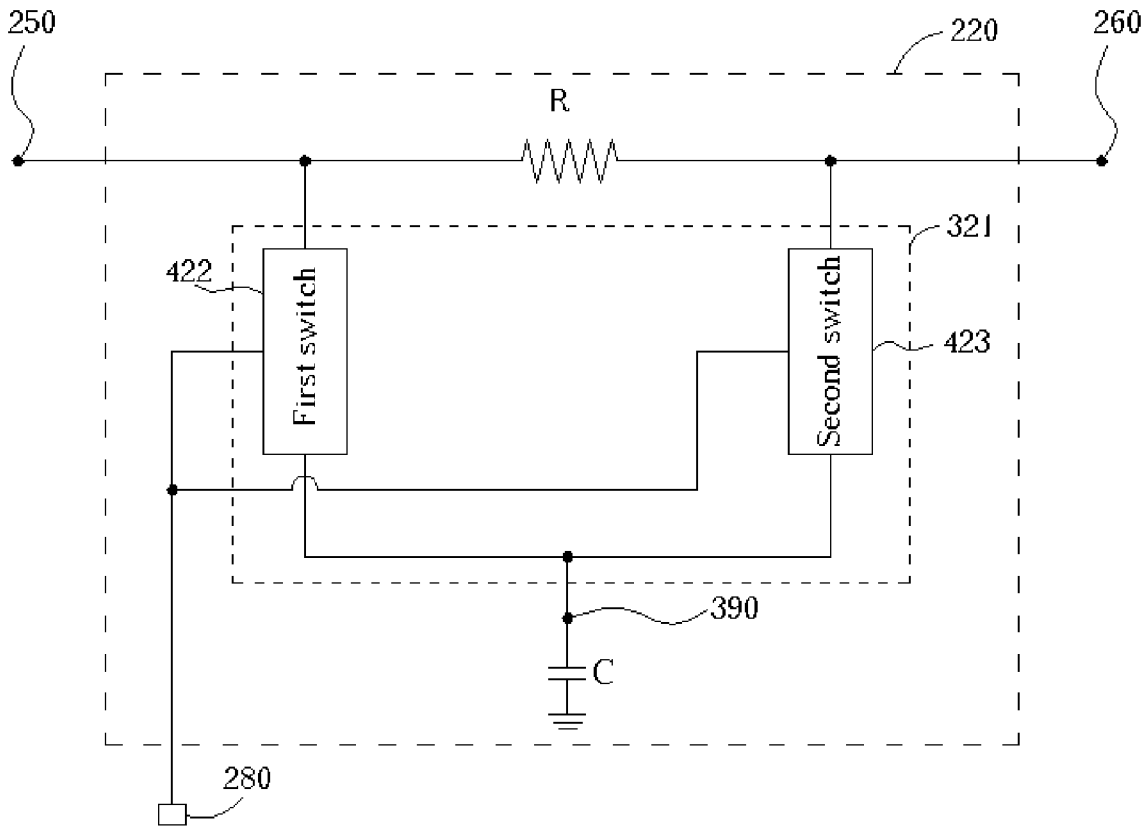
FIG. 4 is an embodiment block diagram of the switch circuit of FIG. 3.

Please refer to FIG. 4, an embodiment block diagram of the switch circuit 321 of FIG. 3 is illustrated. In FIG. 4 the switch circuit 321 contains a first switch 422 and a second switch 423. The first switch 422 is electrically coupled between the first node 250 and the fourth node 390. When the switching circuit 220 is at the first state, the switching control signal 280 turns on the first switch 422, for coupling the first node 250 to the fourth node 390. When the switching circuit 220 is at the second state, the switching control signal 280 turns off the first switch 422. The second switch 423 electrically couples the second node 260 to the fourth node 390. When the switching circuit 220 is at the first state, the switching control signal 280 turns off the second switch 423. When the switching circuit 220 is at the second state, the switching control signal 280 turns on the second switch 423, for coupling the second node 260 to the fourth node 390.

Figure 5:
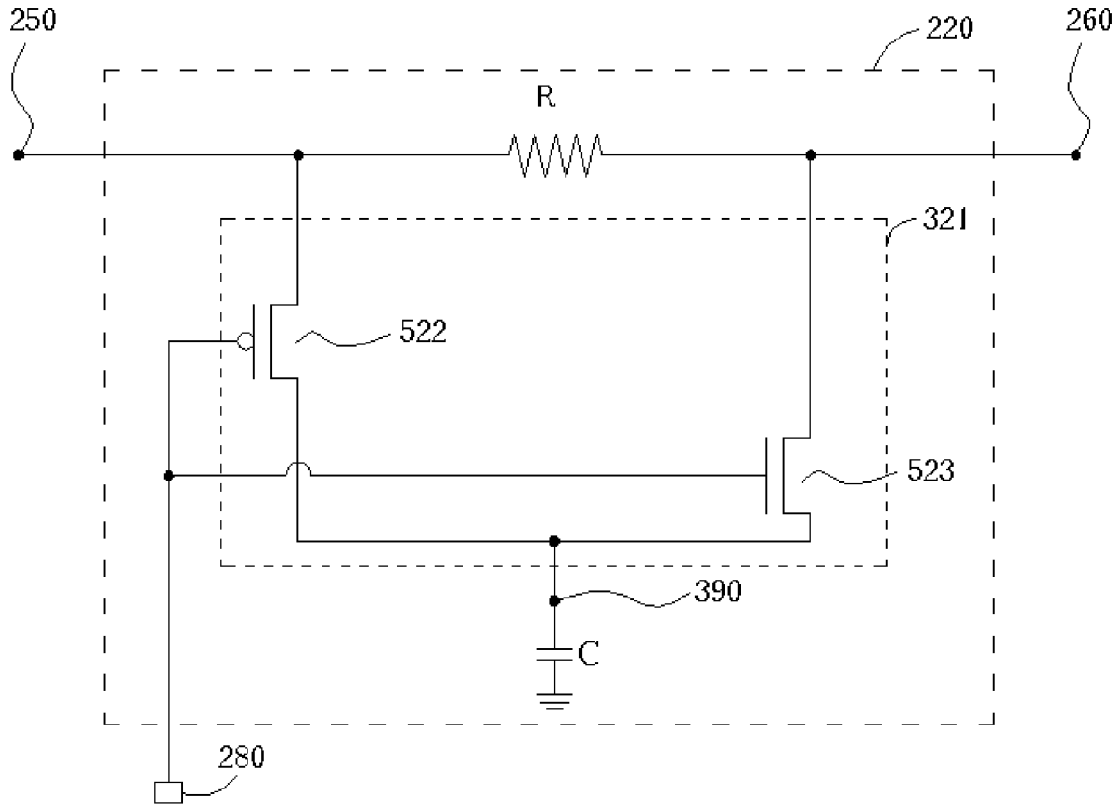
FIG. 5 is an embodiment circuit diagram of FIG. 4.

Please refer to FIG. 5, an embodiment circuit diagram of FIG. 4 is illustrated. In FIG. 5 a PMOS transistor 522 is used to implement the first switch 422 of FIG. 4, having the gate terminal electrically coupled to the switching control signal 280, the source terminal electrically coupled to the first node 250, and the drain terminal electrically coupled to the fourth node 390. An NMOS transistor 523 is used to implement the second switch 423 of FIG. 4, having the gate terminal electrically coupled to the switching control signal 280, the drain terminal electrically coupled to the second node 260, and the source terminal electrically coupled to the fourth node 390. For satisfying the requirements of the switching circuit 220 under the two different states, when the switching circuit 220 is at the first state, the channel between the drain and the source terminal of the PMOS transistor 522 is closed and the channel between the drain and the source terminal of the NMOS transistor 523 is open. So the switching control signal 280, which is used to control the PMOS transistor 522 and the NMOS transistor 523, should be at a low potential when the switching circuit 220 is at the first state. When the switching circuit 220 is at the second state, the channel between the drain and the source terminal of the PMOS transistor 522 is open and the channel between the drain and the source terminal of the NMOS transistor 523 is closed, so the switching control signal 280 should be at a high potential when the switching circuit 220 is at the second state. The switching control signal 280 can be implemented with an on-chip digital timer, a timing delay control signal or a feedback circuit shown in FIG. 6.

Figure 6:
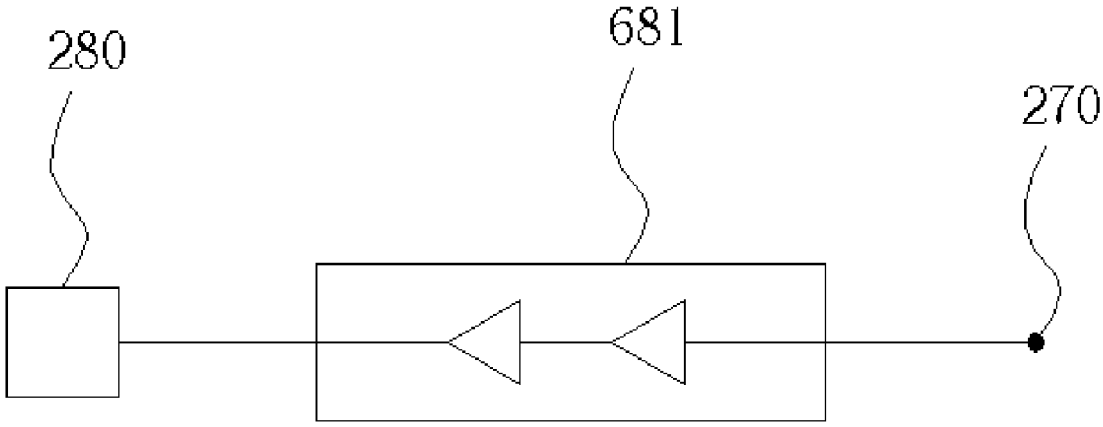
FIG. 6 is an embodiment block diagram of a feedback circuit for using in company with the circuit of FIG. 5.

Please refer to FIG. 6, an embodiment block diagram of a feedback circuit for using in company with the circuit of FIG. 5 is illustrated. In FIG. 6 the input end of an inverter chain 681 is electrically coupled to the third node 270 of the stabilizing circuit 230 of FIG. 2, the output end is used to provide the switching control signal 280. It generates the switching control signal 280 according to the third voltage signal $V_{reg}$ on the third node 270. Before the output voltage of the stabilizing circuit 230 reaches a threshold voltage, the third voltage signal $V_{reg}$ will be determined as at a low potential. For speeding up the voltage regulation process, the switching circuit 220 is at the first state. After the output voltage of the voltage regulator 230 become larger than the threshold voltage, the third voltage signal $V_{reg}$ will be determined as at a high potential. The switching circuit 220 is at the second state in order to make the whole circuit suppress noise and regulate voltage at the same time. Hence, the inverter chain 681 contains an even number of inverters, so the switching control signal 280 can switch the switching circuit 220 between two different states correctly.

Figure 7:
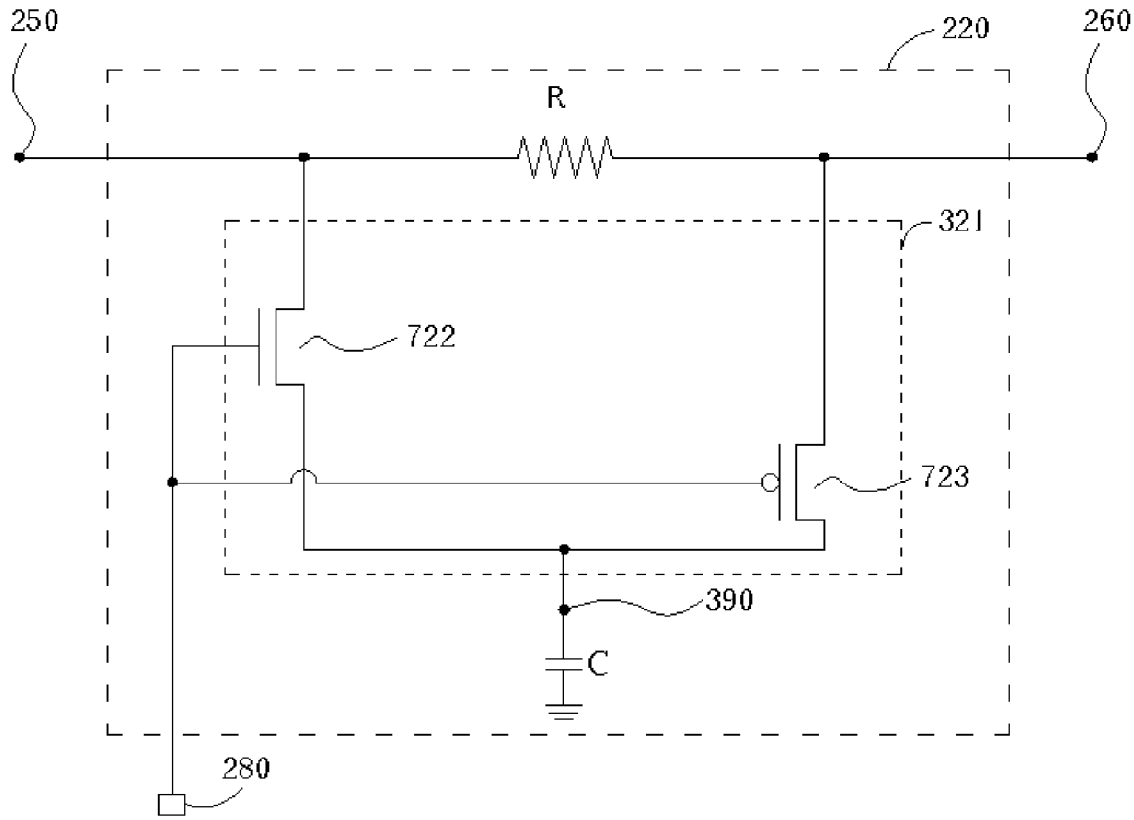
FIG. 7 is an embodiment circuit diagram of FIG. 4.

Please refer to FIG. 7, another embodiment circuit diagram of FIG. 4 is illustrated. As shown in FIG. 7, an NMOS transistor 722 is used to implement the first switch 422 of FIG. 4, having the gate terminal electrically coupled to the switching control signal 280, the drain terminal electrically coupled to the first node 250, the source terminal electrically coupled to the fourth node 390. A PMOS transistor 723 is used to implement the second switch 423 of FIG. 4, having the gate terminal electrically coupled to the switching control signal 280, the source terminal electrically coupled to the second node 260, the drain terminal electrically coupled to the fourth node 390. For satisfying the requirements of the switching circuit 220 under the two different states, when the switching circuit 220 is at the first state, the switching control signal 280 is at a high potential. When the switching circuit 220 is at the second state, the switching control signal 280 is at a low potential. The switching control signal 280 can be implemented with an on-chip digital timer, a timing delay control signal or a feedback circuit shown in FIG. 8.

Figure 8:
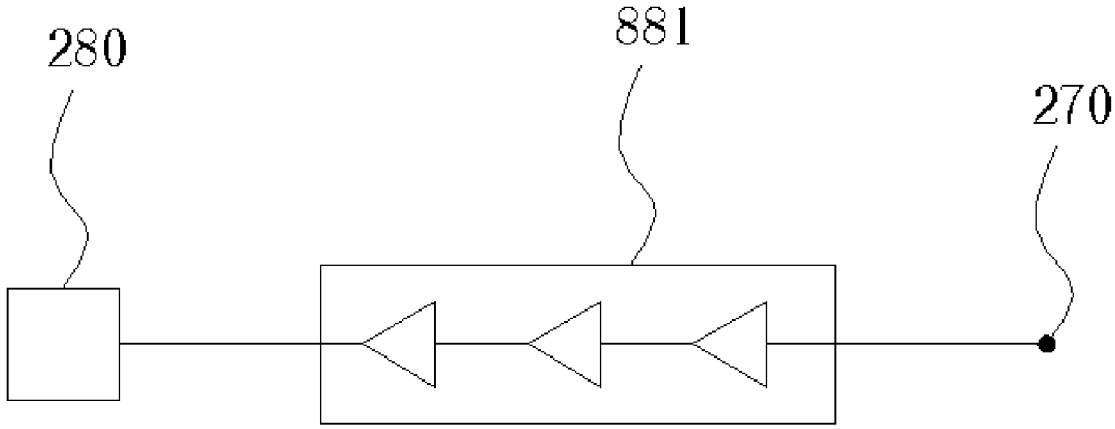
FIG. 8 is an embodiment block diagram of a feedback circuit for using in company with the circuit of FIG. 7.

Please refer to FIG. 8, an embodiment block diagram of a feedback circuit for using in company with the circuit of FIG. 7 is illustrated. In FIG. 8, the input end of an inverter chain 881 is electrically coupled to the third node 270 of the stabilizing circuit 230 of FIG. 2. The output end is used to provide the switching control signal 280. The operation principle is similar to FIG. 6, the difference is that in FIG. 8 the inverter chain 881 contains an odd number of inverters, so the switching control signal 280 can switch the switching circuit 220 between the two states correctly.

Figure 9:
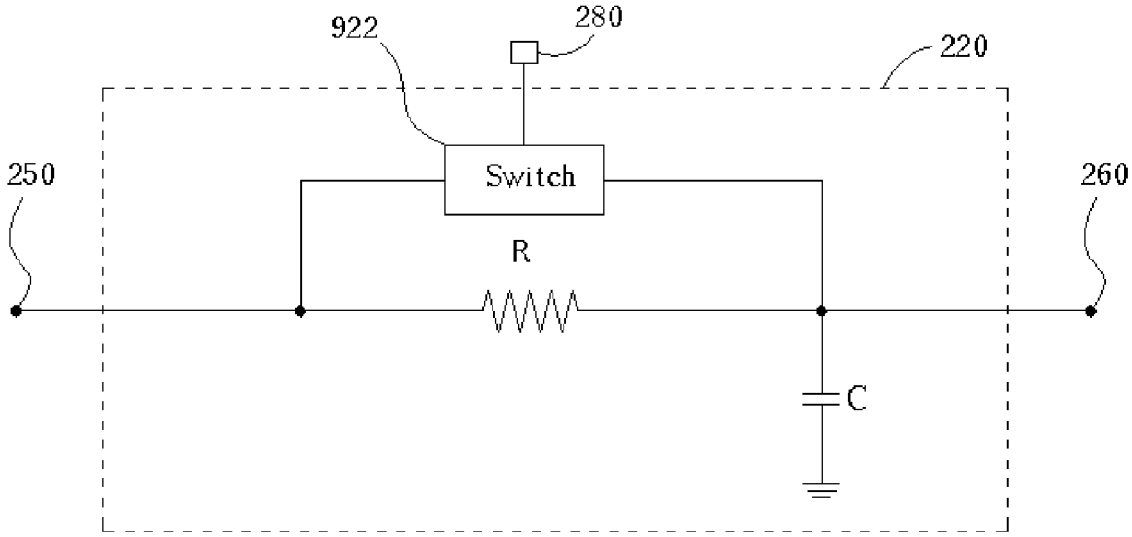
FIG. 9 is an embodiment block diagram of the switching circuit of FIG. 2.

Besides the block diagram shown in FIG. 3, there are various other ways to implement the switching circuit 220 of FIG. 2. For example, another embodiment block diagram of the switching circuit 220 of FIG. 2 is illustrated. In FIG. 9 the switching circuit 220 contains a resistor R, a capacitor C, and a switch 922. The resistor R is electrically coupled between the first node 250 and the second node 260. The capacitor C is electrically coupled between the second node 260 and the ground. The switch 922 is electrically coupled between the first node 250 and the second node 260. The switch 922 can switch the switching circuit 220 between the first state and the second state according the switching control signal 280. When the switching circuit 220 is at the first state, the switching control signal 280 turns on the switch 922, for coupling the first node 250 with the second node 260. At this time the first voltage signal $V_1$ on the first node 250 can be coupled to the second node 260 without being filtered, so the switching circuit 220 is substantially equivalent to a voltage follower. When the switching circuit 220 is at the second state, the switching control signal 280 turns off switch 922. At this time the switching circuit 220 becomes a RC low pass filter.

Figure 10:
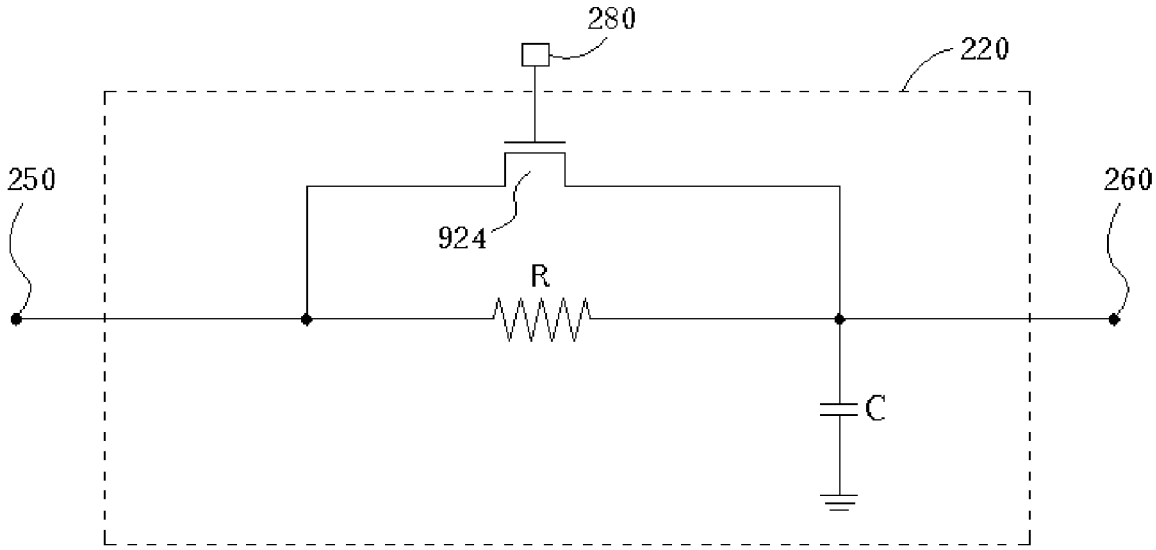
FIG. 10 is an embodiment circuit diagram of FIG. 9.

Please refer to FIG. 10, an embodiment circuit diagram of FIG. 9 is illustrated. In FIG. 10 an NMOS transistor 924 is used to implement the switch 922 of FIG. 9. The NMOS transistor 924 has the gate terminal electrically coupled to the switching control signal 280, a first terminal electrically coupled to the first node 250, and a second terminal electrically coupled to the second node 260. For satisfying the requirement of the switching circuit 220 under two different states, when the switching circuit 220 is at the first state, the channel between the first terminal and the second terminal of the NMOS transistor 924 is closed, and the switching control signal 280 that couples to the gate of the NMOS transistor 924 is at a high potential. When the switching circuit 220 is at the second state, the channel between the first terminal and the second terminal of the NMOS transistor 924 is open, and the switching control signal 280 is at a low potential. The switching control signal 280 can be implemented with an on-chip digital timer, a timing delay control signal or a feedback circuit shown in FIG. 11.

Figure 11:
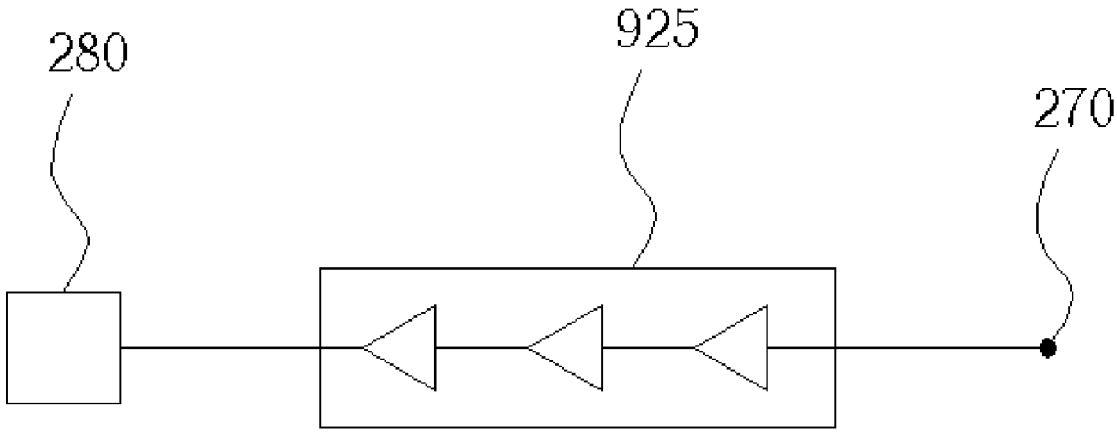
FIG. 11 is an embodiment block diagram of a feedback circuit for using in company with the circuit of FIG. 10.

Please refer to FIG. 11, an embodiment block diagram of a feedback circuit for using in company with the circuit of FIG. 10 is illustrated. In FIG. 11 the input end of an inverter chain 925 is electrically coupled to the third node 270 of the stabilizing circuit 230 of FIG. 2. The output end of the inverter chain 925 is used to provide the switching control signal 280. The operation principle is similar to the feedback circuit shown in FIG. 6 and FIG. 8. However, the inverter chain 925 shown in FIG. 11 contains an odd number of inverters, so the switching control signal 280 can switch the switching circuit 220 between the two states correctly.

Figure 12:
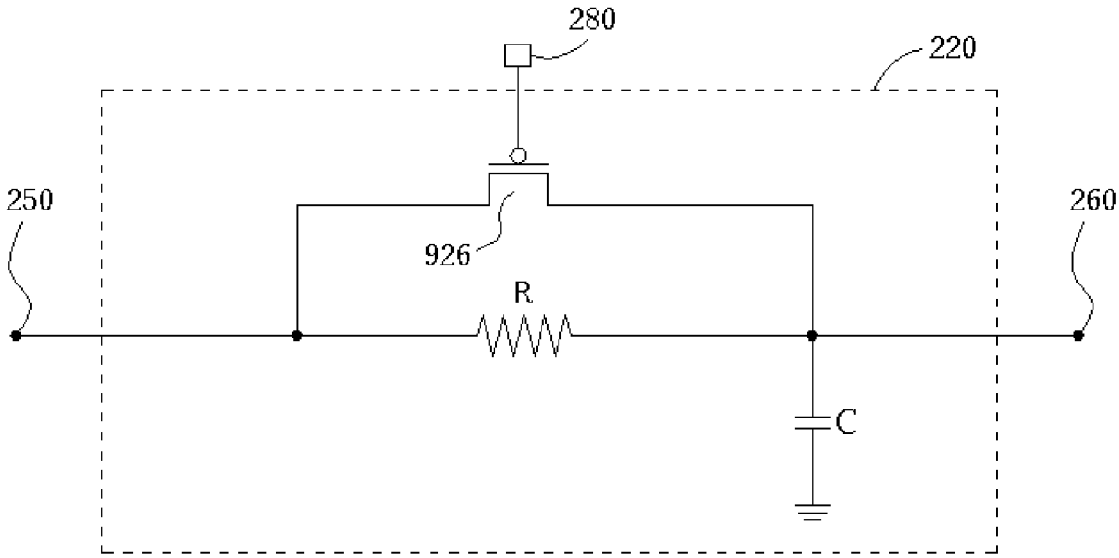
FIG. 12 is an embodiment circuit diagram of FIG. 9.

Please refer to FIG. 12, an embodiment circuit diagram of FIG. 9 is illustrated. Similar to FIG. 10, in FIG. 12 a PMOS transistor 926 is used to implement switch 922 of FIG. 9. The PMOS transistor 926 has the gate terminal electrically coupled to the switching control signal 280, a first terminal electrically coupled to the first node 250, and a second terminal electrically coupled to the second node 260. For satisfying the requirement of the switching circuit 220 under the two different states, when the switching circuit 220 is at the first state, the channel between the first terminal and the second terminal of the PMOS transistor 926 must be closed. Hence, the switching control signal 280 coupled to the gate of the PMOS transistor 926 should be at a low potential. When the switching circuit 220 is at the second state, the channel between the first terminal and the second terminal of the PMOS transistor 926 must be opened, so the switching control signal 280 should be at a high potential. The switching control signal 280 can be implemented with an on-chip digital timer, a timing delay control signal or a feedback circuit shown in FIG. 13.

Figure 13:
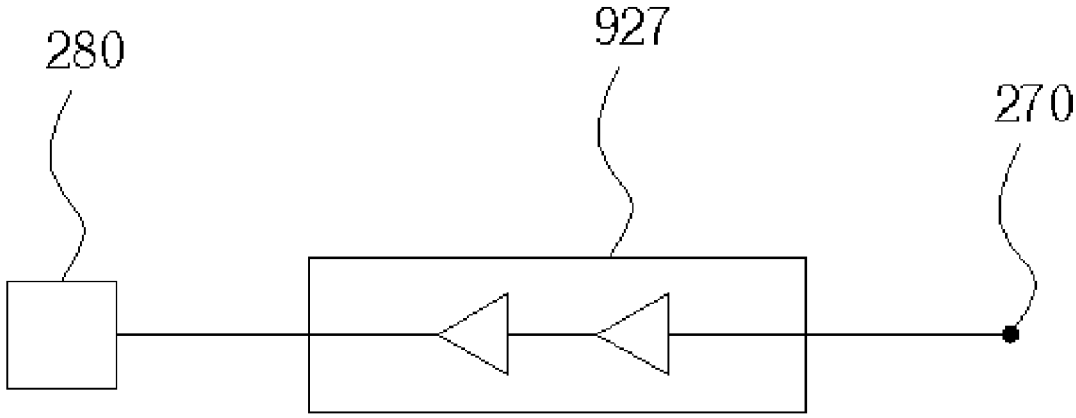
FIG. 13 is an embodiment block diagram of a feedback circuit for using in company with the circuit of FIG. 12.

Please refer to FIG. 13, an embodiment block diagram of a feedback circuit for using in company with the circuit of FIG. 12 is illustrated. In FIG. 13 the input end of an inverter chain 927 is electrically coupled to the third node 270 of the stabilizing circuit 230 of FIG. 2. The output end of the inverter chain 927 is used to provide the switching control signal 280. The main principle is similar to a feedback circuit of FIG. 6, FIG. 8, and FIG. 11. However, in FIG. 13 the inverter chain 927 should contains an even number of inverters, so that the switching control signal 280 can switch the switching circuit 220 between the two states correctly.

In contrast to the prior art, the low noise voltage regulator circuit of the present invention has a switching circuit that can switch between two different states. The switching circuit can switch to a first state to serve as a voltage follower for speeding up the stability of output voltage signals, and switch to a second state and serves as a RC low pass filter for suppressing noise. By switching the switching circuit between these two states, the low noise voltage regulator circuit of the present invention can simultaneously have fast stable and low noise output voltage.

Those skills in the art will readily observe that numerous modification and alternation of the device may be made while retaining the teaching of the invention. Accordingly, the above disclosure should be construed as limited only by the metes and bounds of the appended claims.

What is claimed is:

1. A low noise voltage regulator circuit for generating a stable voltage signal with low noise, the low noise voltage regulator circuit comprising:

a reference voltage generator, electrically coupled to a first node, for generating a first voltage signal and outputting the first voltage signal to the first node;

a switching circuit, electrically coupled to the first node, a second node, and a switching control signal, for receiving the first voltage signal from the first node, processing the first voltage signal to generate a second voltage signal, and outputting the second voltage signal to the second node, wherein the switching circuit switches between a first state and a second state, when the switching circuit is at the first state, it is substantially equivalent to a voltage follower, the first voltage signal is coupled to become the second voltage signal without being filtered, when the switching circuit is at the second state, it is substantially equivalent to a RC low pass filter, the first voltage signal is filtered to become the second voltage signal; and a stabilizing circuit electrically coupled between the second node and a third node and including a negative feedback path, the stabilizing circuit receives the second voltage signal from the second node and provides the stable voltage signal to the third node.

2. The low noise voltage regulator circuit of claim 1, wherein the switching circuit comprises:

a resistor, electrically coupled between the first node and the second node;

a capacitor, electrically coupled between a fourth node and ground; and a switch circuit, electrically coupled to the first node, the second node, the fourth node, and the switching control signal, the switch circuit can switch the switching circuit between the first state and the second state according to the switching control signal, when the switching circuit is at the first state, the switch circuit conducts the first node with the fourth node, when the switching circuit is at the second state, the switch circuit conducts the second node with the fourth node.

3. The low noise voltage regulator circuit of claim 2, wherein the switch circuit comprises:

a first switch, electrically coupled between the first node and the fourth node, the switching control signal can turn on or turn off the first switch, when the switching circuit is at the first state, the switching control signal turns on the first switch for conducting the first node with the fourth node, when the switching circuit is at the second state, the switching control signal turns off the first switch; and a second switch, electrically coupled between the second node and the fourth node, the switching control signal can turn on or turn off the second switch, when the switching circuit is at the first state, the switching control signal turns off the second switch, when the switching circuit is at the second state, the switching control signal turns on the second switch for conducting the first node with the fourth node.

4. The low noise voltage regulator circuit of claim 3, wherein:

the first switch is a PMOS transistor having the gate terminal electrically coupled to the switching control signal, the source terminal electrically coupled to the first node, and the drain terminal electrically coupled to the fourth node; and the second switch is an NMOS transistor having the gate terminal electrically coupled to the switching control signal, the drain terminal electrically coupled to the second node, and the source terminal electrically coupled to the fourth node;

wherein when the switching circuit is at the first state, the switching control signal is at a low potential, when the switching circuit is at the second state, the switching control signal is at a high potential.

5. The low noise voltage regulator circuit of claim 4 further comprising an inverter chain with an even number of inverters serially coupled together, the input end being electrically coupled to the third node, the output end outputting the switching control signal according to the voltage of the third node and being electrically coupled to the gate of the PMOS transistor and the gate of the NMOS transistor.

6. The low noise voltage regulator circuit of claim 3, wherein:

the first switch is an NMOS transistor having the gate terminal electrically coupled to the switching control signal, the drain terminal electrically coupled to the first node, and the source terminal electrically coupled to the fourth node;

the second switch is a PMOS transistor having the gate terminal electrically coupled to the switching control signal, the source terminal electrically coupled to the second node, and the drain terminal electrically coupled to the fourth node;

wherein when the switching circuit is at the first state, the switching control signal is at a high potential, when the switching circuit is at the second state, the switching control signal is at a low potential.

7. The low noise voltage regulator circuit of claim 6 further comprising an inverter chain with an odd number of inverters serially coupled together, the input end being electrically coupled to the third node, the output end outputting the switching control signal according to the voltage of the third node and being electrically coupled to the gate of the PMOS transistor and the gate of the NMOS transistor.

8. The low noise voltage regulator circuit of claim 1, wherein the switching circuit comprises:

a resistor, electrically coupled between the first node and the second node;

a capacitor, electrically coupled between the second node and ground; and a switch, electrically coupled between the first node and the second node, the switch switches the switching circuit between the first state and the second state according to the switching control signal, when the switching circuit is at the first state, the switching control signal turns on the switch to conduct the first node with the second node, when the switching circuit is at the second state, the switching control signal turns off the switch.

9. The low noise voltage regulator circuit of claim 8, wherein the switch is an NMOS transistor having the gate terminal electrically coupled to the switching control signal, a first terminal electrically coupled to the first node, and a second terminal electrically coupled to the second node, when the switching circuit is at the first state, the switching control signal is at a high potential, when the switching circuit is at the second state, the switching control signal is at a low potential.

10. The low noise voltage regulator circuit of claim 9 further comprising an inverter chain with an odd number of inverters serially coupled together, the input end of the inverter chain being electrically coupled to the third node, the output end outputting the switching control signal according to the voltage of the third node and being electrically coupled to the gate of the NMOS transistor.

11. The low noise voltage regulator circuit of claim 8, wherein the switch is a PMOS transistor having the gate terminal electrically coupled to the switching control signal, a first terminal electrically coupled to the first node, and a second terminal electrically coupled to the second node, when the switching circuit is at the first state, the switching control signal is at a low potential, when the switching circuit is at the second state, the switching control signal is at a high potential.

12. The low noise voltage regulator circuit of claim 11 further comprising an inverter chain with an even number of inverters serially coupled together, the input end of the inverter chain being electrically coupled to the third node, the output end outputting the switching control signal according to the voltage of the third node and being electrically coupled to the gate of the PMOS transistor.

13. A low noise voltage regulator circuit for generating a stable voltage signal with low noise, the low noise voltage regulator circuit comprising:

a reference voltage generator having a first node for providing a first voltage signal;

a stabilizing circuit having an input node and an output node, the stabilizing circuit includes a negative feedback path for providing the stable voltage signal at the output node;

an intermediate module coupled between the first node and the input node, the intermediate module having a first state and the second state, wherein when the intermediate module is at the first state the first voltage signal is coupled to the input node without being filtered, and when the intermediate module is at the second state the first voltage signal is coupled to the input node after being filtered.

* * * * *